US012037764B2

(12) United States Patent
Bossé

(10) Patent No.: US 12,037,764 B2
(45) Date of Patent: Jul. 16, 2024

(54) EARTH-WORKING BUCKET WITH REMOVABLE BOWL

(71) Applicant: 9257-5810 QUÉBEC INC., Plessisville (CA)

(72) Inventor: Dave Bossé, Saint-Ferdinand (CA)

(73) Assignee: 9257-5810 QUÉBEC INC., Plessisville (CA)

( * ) Notice: Subject to any disclaimer, the term of this patent is extended or adjusted under 35 U.S.C. 154(b) by 178 days.

(21) Appl. No.: 17/522,482

(22) Filed: Nov. 9, 2021

(65) Prior Publication Data

US 2022/0145577 A1 May 12, 2022

Related U.S. Application Data

(60) Provisional application No. 63/112,296, filed on Nov. 11, 2020.

(51) Int. Cl.
*E02F 3/40* (2006.01)

(52) U.S. Cl.
CPC ..... *E02F 3/40* (2013.01)

(58) Field of Classification Search
CPC ..... E02F 3/40; E02F 3/60; E02F 3/58; E02F 3/36; E02F 9/2883
See application file for complete search history.

(56) References Cited

U.S. PATENT DOCUMENTS

| | | | | | |
|---|---|---|---|---|---|
| 1,077,486 | A * | 11/1913 | McKee | E02F 3/40 | 37/444 |
| 1,107,252 | A * | 8/1914 | Black | E02F 3/40 | 37/444 |
| 1,479,340 | A * | 1/1924 | Trainor | E02F 3/40 | 37/444 |
| 1,539,863 | A * | 6/1925 | Edward | E02F 3/40 | 37/444 |
| 1,745,436 | A * | 2/1930 | Miley | E02F 3/40 | 37/444 |
| 2,584,416 | A * | 2/1952 | Boehringer | E02F 3/40 | 37/444 |
| 9,279,231 | B2 * | 3/2016 | Bienfang | E02F 9/2883 | |
| 2012/0279095 | A1 * | 11/2012 | Feld | E02F 3/60 | 37/444 |

FOREIGN PATENT DOCUMENTS

| | | | | |
|---|---|---|---|---|
| FR | 2939160 A1 * | 6/2010 | ..... | E02F 3/40 |

* cited by examiner

*Primary Examiner* — Adam J Behrens
*Assistant Examiner* — Blake E Scoville
(74) *Attorney, Agent, or Firm* — NORTON ROSE FULBRIGHT CANADA LLP

(57) ABSTRACT

A bucket has a bowl defining a lip of the bucket, and an upper frame configured for interfacing the bucket to equipment. The bowl and the upper frame being against one another at seams so as to define an inner cavity. Supports extend over the seams, with at least one of the supports connected to the upper frame and defining at least one abutment surface facing at least partially upwardly, and with at least another one of the supports connected to the bowl and defining at least another abutment surface facing at least partially downwardly, the abutment surfaces being in contact abutment with one another.

20 Claims, 6 Drawing Sheets

EARTH-WORKING BUCKET WITH REMOVABLE BOWL

CROSS-REFERENCE TO RELATED APPLICATION

The present application claims the priority of U.S. Patent Application No. 63/112,296, filed on Nov. 11, 2020, the contents of which are incorporated herein by reference.

TECHNICAL FIELD

The present application relates to excavation equipment such as earth-working buckets, also known as excavation buckets and dippers.

BACKGROUND OF THE ART

Excavation equipment, and in particular earth working buckets such as cable shovel dippers, are used, amongst other applications, for heavy earthwork applications such as mining and excavation. Buckets are hollow tools defining a bowl to carry earth. The buckets typically have a leading edge for the bowl, also known as the lip, that performs a digging action, so as to fill the cavity of the bucket. A closable door is on the trailing end of the bucket, and may be opened to empty the bucket of its content. Due to the weight of the content in the bucket, and the harsh conditions of operation (e.g., moisture, dirt, abrasiveness), parts of the bucket may become worn and may require replacement. For example, the bowl portion of the bucket may need replacement, and this require metal works, e.g. cutting, grinding, welding, etc, causing downtime to production equipment.

SUMMARY

Therefore, in accordance with an aspect of the present disclosure, there is provided a bucket comprising: a bowl defining a lip of the bucket, an upper frame configured for interfacing the bucket to equipment, the bowl and the upper frame being against one another at seams so as to define an inner cavity, and supports extending over the seams, with at least one of the supports connected to the upper frame and defining at least one abutment surface facing at least partially upwardly, and with at least another one of the supports connected to the bowl and defining at least another abutment surface facing at least partially downwardly, the abutment surfaces being in contact abutment with one another.

In accordance with another aspect of the present disclosure, there is provided a method for assembling a bucket comprising: positioning an upper frame on top of a bowl along seams; attaching supports to the upper frame and/or to the bowl, the supports overlapping the seam, including abutting at least one abutment surface of the supports connected to the upper frame and facing at least partially upwardly, against at least another abutment surface of the supports connected to the bowl and facing at least partially downwardly.

DETAILED DESCRIPTION

FIGS. 1 to 6 show buckets such as used for excavation, for example as part of a cable shovel dipper of the type generally used on electric-cable shovels to scoop ore from the ground, and is an example of the numerous types of excavation equipment that may benefit from the configuration described hereinafter for a mechanically attached bowl. Other types of excavation equipment and like earth working buckets include electric rope shovels, hydraulic face shovels, hydraulic backhoe, loader, dragline, bucket-wheel excavator, etc. However, for simplicity, the present disclosure refers to the bucket 10, although it is understood that other excavation equipment may use the configuration described hereinafter.

Figure 1:
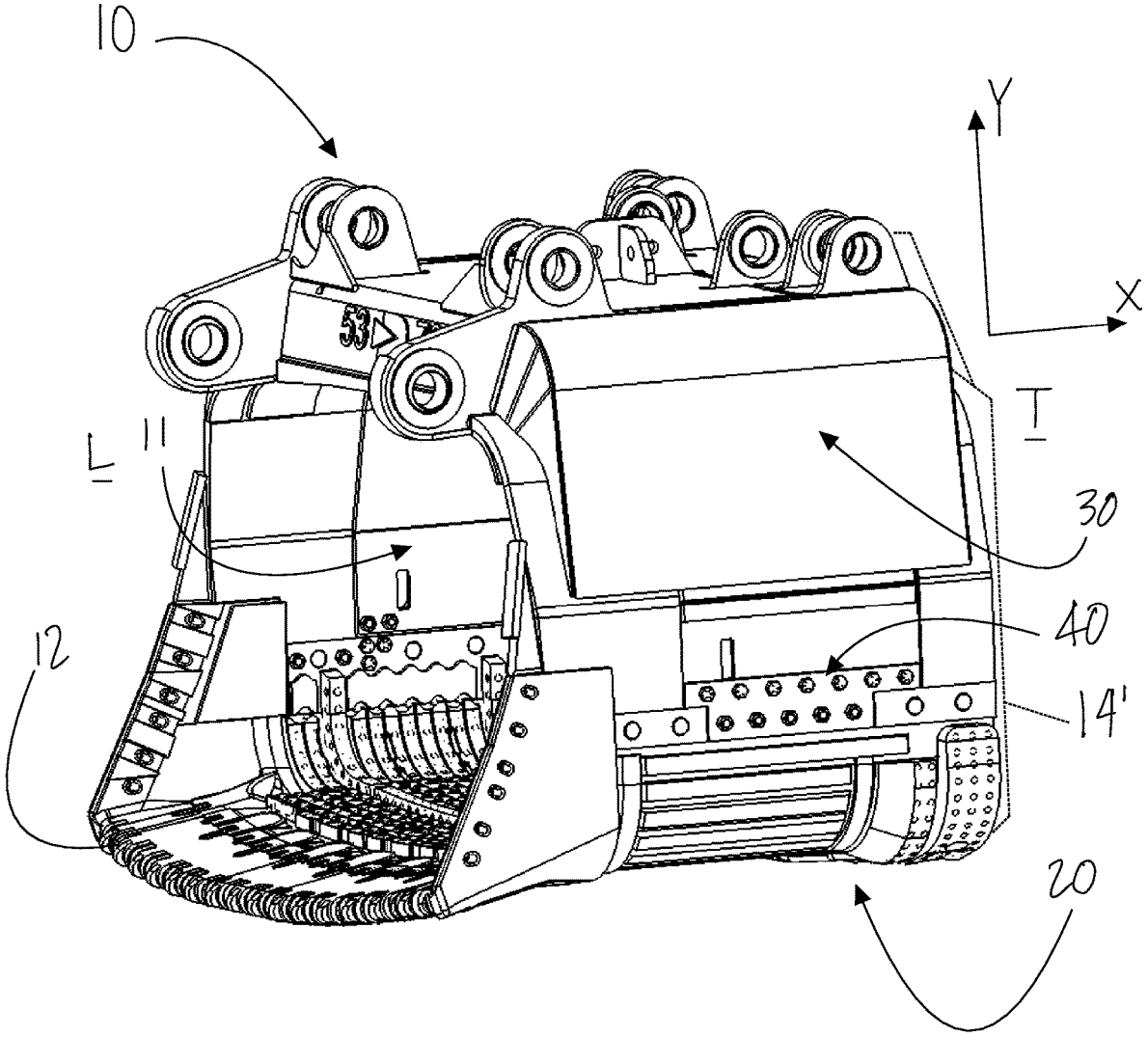
FIG. 1 is a perspective view of an excavation bucket with removable bowl in accordance with a first variant of the present disclosure.
Figure 2:
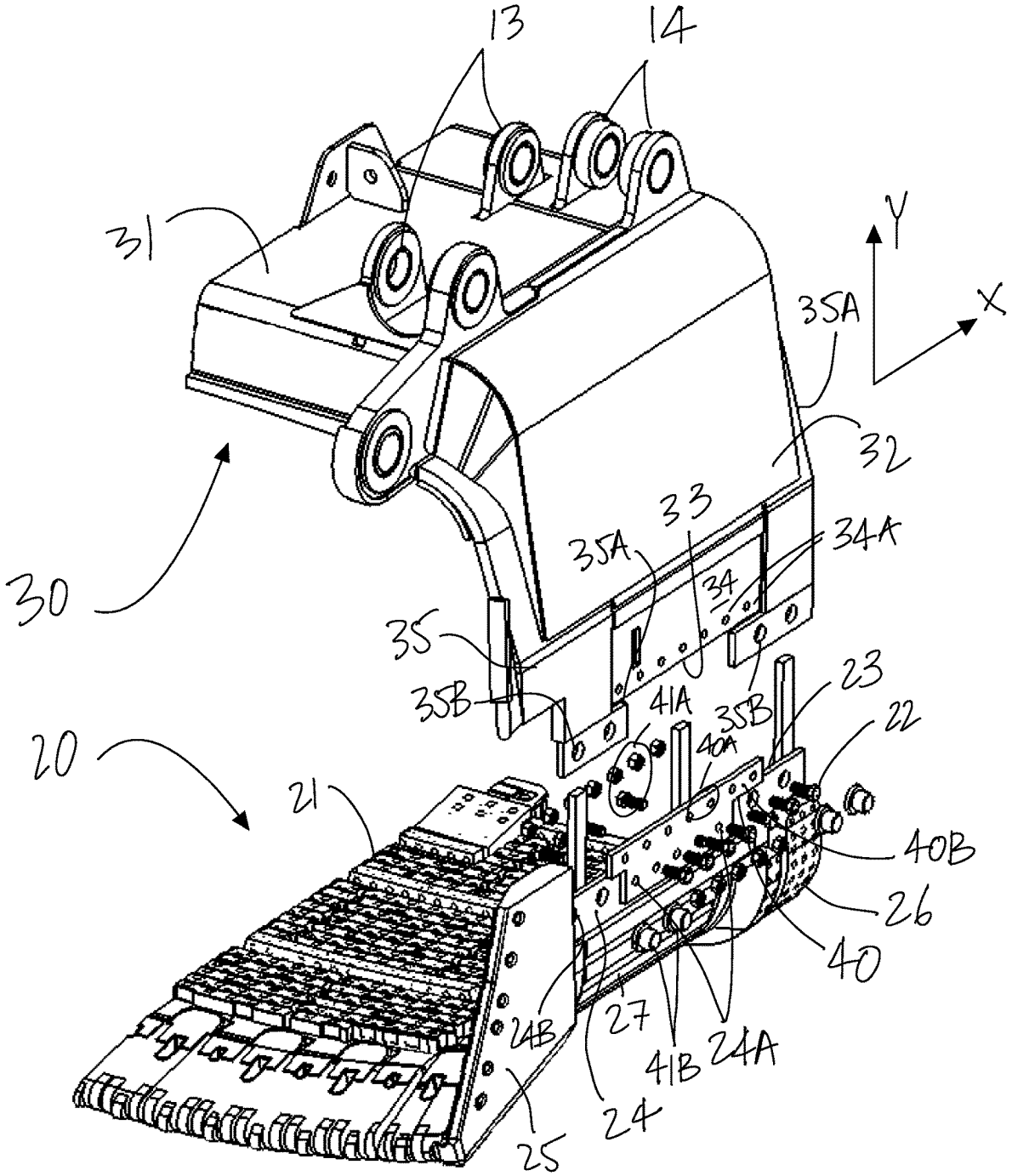
FIG. 2 is an assembly view of the excavation bucket of FIG. 1.
Figure 3:
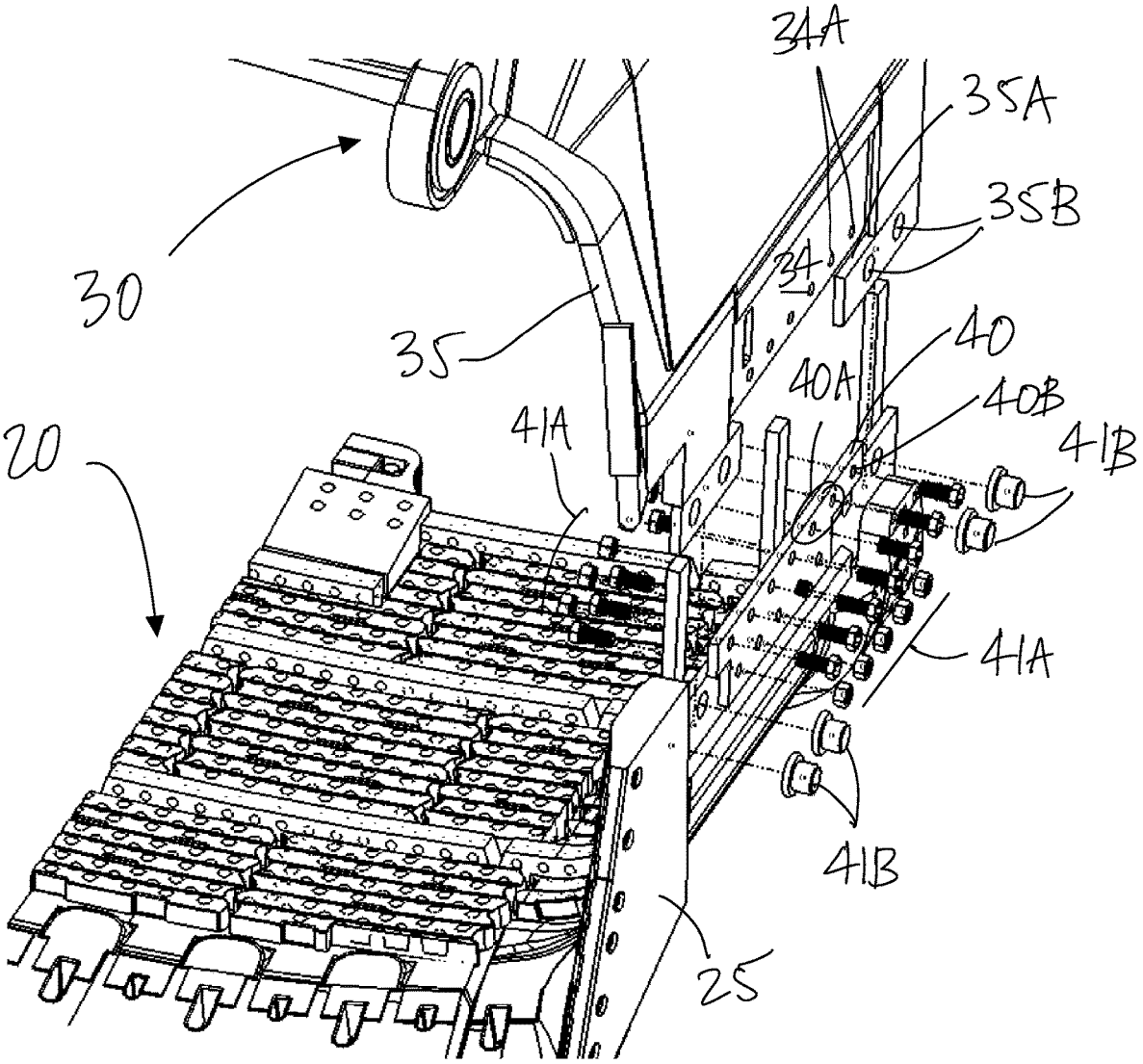
FIG. 3 is another assembly view of the excavation bucket of FIG. 1.

As a general description, with reference to FIGS. 1 to 3, the bucket 10 has a main body, generally tubular in shape, or hollow as another way to describe the body, having a leading end L for excavation, and a trailing end T opposite the leading end. The bucket 10 defines an inner cavity 11 for receiving earth or like excavation products, with the lip 12 leading the excavating. The lip 12 is shown generically in FIG. 1, but may have numerous components, such as teeth, shrouds, C-clamps, wear plates, to name a few, and it may differ in shape and configuration to what is shown in FIG. 1. Various connectors 13 are provided on a top surface of the bucket 10, to connect the bucket 10 to a handle, to a stick, to an arm, etc, of a cable shovel dipper, crane or like equipment or vehicle. Any appropriate type of connector may be used. In a common use, excavation products enter the main body of the bucket 10 via the leading end L, to remain in the bucket 10 as held there by a door or trap, shown schematically as 14' in FIG. 1. When the door 14' is opened, the excavation products may be unloaded via the trailing end T.

Pivot supports 14 may be adjacent to a trailing end of the bucket 10. The pivot supports 14 may be provided on both sides of the bucket 10, and are above a trailing opening of the bucket 10, through which the load of earth in the inner cavity 11 of the bucket 10 may be unloaded. The pivot supports 14 are provided to pivotally support the door 14', which door opens the trailing opening and closes the trailing opening. The door 14' may be closed during the excavating or digging, while the door 14' may be selectively opened to unload the content of the bucket 10.

Still referring to FIGS. 1 to 3, the body of the bucket 10 may be made of two interconnected frame members, namely a bowl 20 and an upper frame 30, and the bowl 20 and the upper frame 30 may be interconnected by a support member 40. The bowl 20 forms the bottom of the bucket 10 and features the lip 12. The upper frame 30 is the upper part of the bucket 10, and features the various connectors 13 and the pivot supports 14, among other features. The upper frame 30 interfaces the bucket 10 to a vehicle or operating equipment, such as to a boom or crane, for example.

The bowl 20 may be defined by a single metallic member, or multiple interconnected members. The bowl 20 has a bottom portion 21 that is generally planar, including the presence of a slight curvature as a possibility, and surface features may be present, such as ribs, reinforcements, channels, etc. The bottom portion 21 may be referred to as a plate, panel, etc. For reference purposes, a X-Y referential is shown, with the bottom portion 21 being generally parallel to the axis X. Lateral portions 22 project upwardly, i.e., along axis Y, on both sides of the bottom portion 21. In a variant, the shape may be known as U-shape. In an aspect, the lateral portions 22 are integrally connected to the bottom portion 21, for example as a monoblock construction, or as welded or otherwise secured permanently together. The bowl 20 may define a curved transition from the bottom portion 21 to the lateral portions 22, as shown. However, this is merely an option as the lateral portions 22 may be in a square relation with the bottom portion 21. The lateral portions 22 are delimited by top edges 23, that will come into contact with corresponding edges of the upper frame 30. In the figures, the top edges 23 are rectilinear surfaces, but other shapes are considered.

As shown, the top edge 23 may be part of a lateral wall portion 24 that is generally flat. The lateral wall portion 24 may be part of the lateral portions 22 of the bowl 20. In an aspect, the lateral wall portion 24 is an elongated plate member, that is planar along axes X and Y. The elongated plate member may have a generally uniform thickness, and may be sheet metal, as one possibility. The lateral wall portion 24 has holes therein, for instance a first set of holes 24A and a second set of holes 24B. The holes 24A of the first set may be smaller in diameter than the holes 24B of the second set, though this is optional. In the illustrated embodiment, all holes 24A and 24B extend in a single row, but other patterns are may be present. The holes 24A and 24B are provided to connect the support member 40 to the bowl 20, as described below.

Other components of the bowl 20 or connected to the bowl 20 include corner lips 25 that extend from the lip 12 to the lateral wall portion 24. The corner lips 25 may be present to assist in directing earth into the bucket 10, and may be part of the lip 12, such as by being welded to a remainder of the lip 12. Reinforcement ribs 26 or like reinforcement members may be formed onto the bowl 20 to reinforce the bowl 20. The reinforcement ribs 26 may extend from top edge 23 on one side of the bowl 20 to top edge 23 on the other side of the bowl 20, but other arrangements are possible as well. Wear members 27 may be on any of the surfaces of the bowl 20, and may be removably connected to the bowl 20, to protect the core material of the bowl 20. These components and others may or may not be present.

Still referring to FIGS. 1 to 3, the upper frame 30 is described in further detail, and may be referred to as frame, structure, top end, upper structure, etc. While the bowl 20 may have a generally U-shape from a leading point of view at L, the upper frame 30 may be said to have an inverted U-shape. The "inverted" is when the bucket 10 is horizontal as in FIG. 1. However, in use the bucket 10 may have other orientations, whereby "inverted" is used to described the horizontal orientation of the upper frame 30.

The upper frame 30 has a top portion 31 that is generally planar, with the connectors 13 and pivot members 14 projecting upwardly from the top portion 31. The top portion 31 may be referred to as a plate, panel, etc. In the X-Y referential, the top portion 31 is generally parallel to the axis X. Lateral portions 32 project downwardly, i.e., along axis Y, on both sides of the top portion 31. In an embodiment, the lateral portions 32 are integrally connected to the top portion 31, for example as a monoblock construction, or as welded or otherwise secured permanently together. The upper frame 30 may define a curved transition from the top portion 31 to the lateral portions 32, as shown, and contributing to the inverted U-shape. However, this is merely an option as the lateral portions 32 may be in a square relation with the top portion 31. The lateral portions 32 are delimited by bottom edges 33, that will come into contact with the corresponding top edges 23 of the bowl 20, in coplanar contact. In the figures, the bottom edges 33 are rectilinear surfaces to match the top edges 23, but other shapes are considered.

As shown, the bottom edge 33 may be part of a lateral wall portion 34 that is generally flat. The lateral wall portion 34 may be part of the lateral portions 32 of the upper frame 30. In an embodiment, the lateral wall portion 34 is an elongated plate member, planar along axes X and Y. The elongated plate member may have a generally uniform thickness, for example in the form of sheet metal, as one possibility. The lateral wall portion 34 has holes therein, for instance holes 34A. The holes 34A may be of the same diameter as the holes 24A of bowl 20, as a possibility. In the illustrated embodiment, all holes 34A extend in a single row, but other patterns are may be present. The holes 34A are provided to connect the support member 40 to the upper frame 30, as described below, with fasteners.

Supports 35 are mounted to the lateral wall portion 34, and may be said to be part of the lateral wall portion 34. In an embodiment, the supports 35 are reinforcement beams on an outer surface of the upper frame 30. A top end of the supports 35 may even curve inwardly as shown to be supported by the top portion 31. The supports 35 may have tabs near a bottom end, the tabs defining shoulders 35A. The shoulder 35A are upwardly facing support surfaces, that will be used in conjunction with the support member 40 as described below, with the support member 40 seated on the shoulders 35A. As part of the supports 35A, such as in the tabs, holes 35B are defined. The holes 35B may have the same diameter as the holes 24B in the lateral wall portion 24 of the bowl 20. The holes 35B are spaced apart in a similar pattern as the holes 24B, such that when the bowl 20 is assembled to the upper frame 30, the holes 35B are aligned with the holes 24B.

Still referring to FIGS. 1 to 3, the support member 40 is shown having an elongated plate body, as one type of body among others. For instance, the support member 40 is machined from a metal plate, but may also be manufactured in other ways, such as by being cast. The support member 40 in the illustrated embodiment has an elongated shape, with a pair of tabs 40B, or like projections, at the end of support member 40. The support member 40 is sized such that undersurfaces of the tabs 40B sit on the shoulders 35A of the supports 35 when the bucket 10 is assembled (FIG. 1). Moreover, a main body of the support member 40, i.e., from which the tabs 40B project, is sized to be fitted between the tabs of the supports 35.

The support member 40 may have two rows of holes 40A. The holes 40A may have the same or similar diameter as the holes 24A in the lateral wall portion 24 of the bowl 20, and as the holes 34A in the lateral wall portion 34 of the upper frame 30. The holes 40A are spaced apart in a similar pattern as the holes 24A and as the holes 34A, such that when the bowl 20 is assembled to the upper frame 30 with the support member 40, the holes 40A are aligned with the holes 24A and the holes 34A.

Fasteners 41A, such as bolts and nuts, or any other type of fastener, may pass through the pairs of holes 24A and 40A, and through the pairs of holes 34A and 40A, so as to secure the support member 40 to the bowl 20 and to the upper frame 30, respectively. In the illustrated embodiment, the nuts of the fasteners 41A may be inward of the bucket 10 for one of the two rows of the support member 40, and outside of the bucket 10 for the other of the two rows of the support member 40. Other arrangements are possible. The fasteners 41A ensure that the support member 40 remains connected to the bowl 20 and to the upper frame 30.

Pins 41B may pass through the pairs of holes 24B and 35B, respectively in the lateral wall portion 24 and in the supports 35. The pins 41B may also be referred to as axles, shafts, dowel pins, etc. and have load bearing capacity. The pins 41B may have a cylindrical body, and are made of a high strength metal, in an embodiment. The pins 41B are hence fitted so as to be solidly received in the holes 24B and 35B. The fitting may be a force fit, an interference fit, among other possibilities. Therefore, the pins 41B assist in having the upper frame 30 support the weight of the bowl 20.

Consequently, when the bucket 10 is assembled in the manner shown in FIG. 1, a seam (a.k.a., junction line, intersection) between the bowl 20 and the upper frame 30 is defined by the top edge 23 and the bottom edge 33 being one against the other, in coplanar engagement. While not shown, joint features may be present at the seam, such as tongue and groove, for example, or other complementary peripheral shapes. The supports 35 of the upper frame 30 overlap the seam, by lying against the lateral wall portion 24 of the bowl 20, with the pins 41B being located beyond this overlap. The support member 40 also overlaps the seam, by being connected to both the lateral wall portions 24 and 34, by the fasteners 41A. Therefore, at the seam between the bowl 20 and the upper frame 30, the supports 35 and the support member 40 define an additional layer(s) of material that adds to the structural integrity of the sides of the bucket 10.

The bowl 20 accommodates earth or like material during use. Therefore, the interconnection between the bowl 20 and the upper frame 30 must take into consideration the weight of the bowl 20 and of the load being carried in the bucket 10. The configuration of the support member 40 contributes to the weight support, with the tabs 40B defining a downwardly facing surface seated on the upwardly facing shoulder 35A of the supports 35. The shoulders 35A are located in the tabs of the supports 35, and the tabs of the supports 35 receive the pins 41B, the pins 41B being in a vertical line with the shoulders 35A and tabs 40B. This assembly of tabs, shoulders and pins is designed to withstand the weight of the bowl 30 and load.

Figure 4:
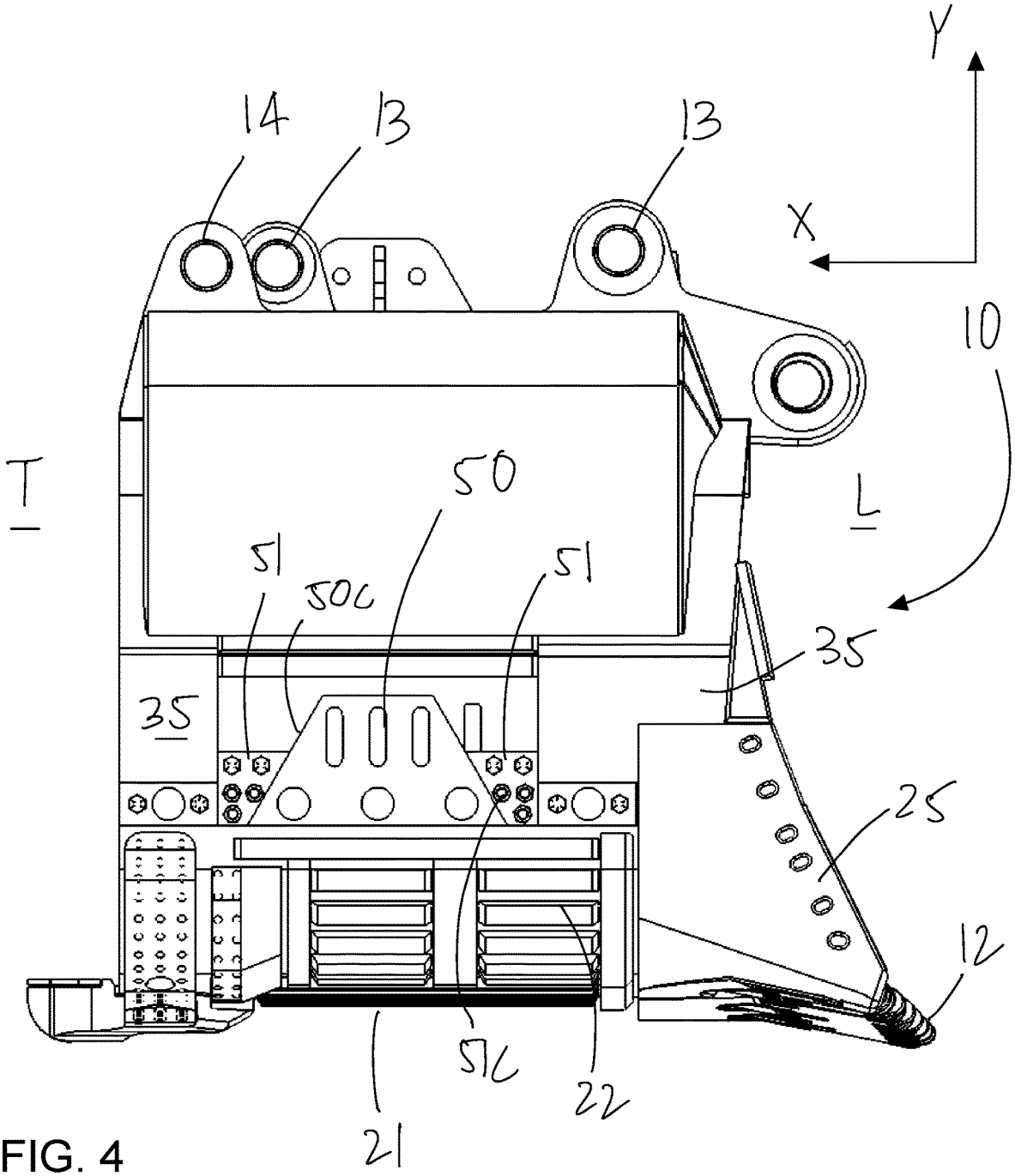
FIG. 4 is a side view of an excavation bucket with removable bowl in accordance with a second variant of the present disclosure.
Figure 5:
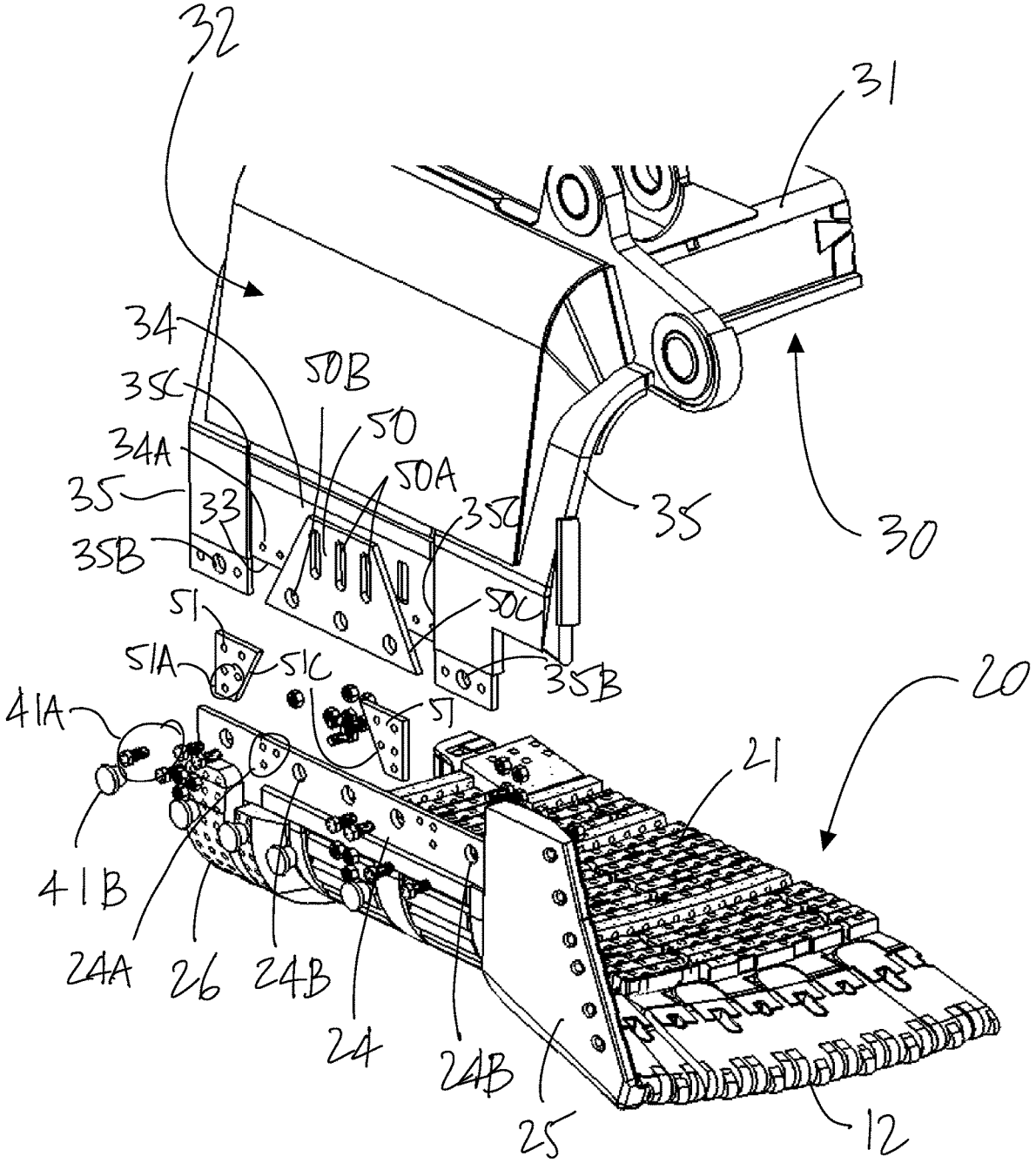
FIG. 5 is an assembly view of the excavation bucket of FIG. 4 from an exterior thereof.
Figure 6:
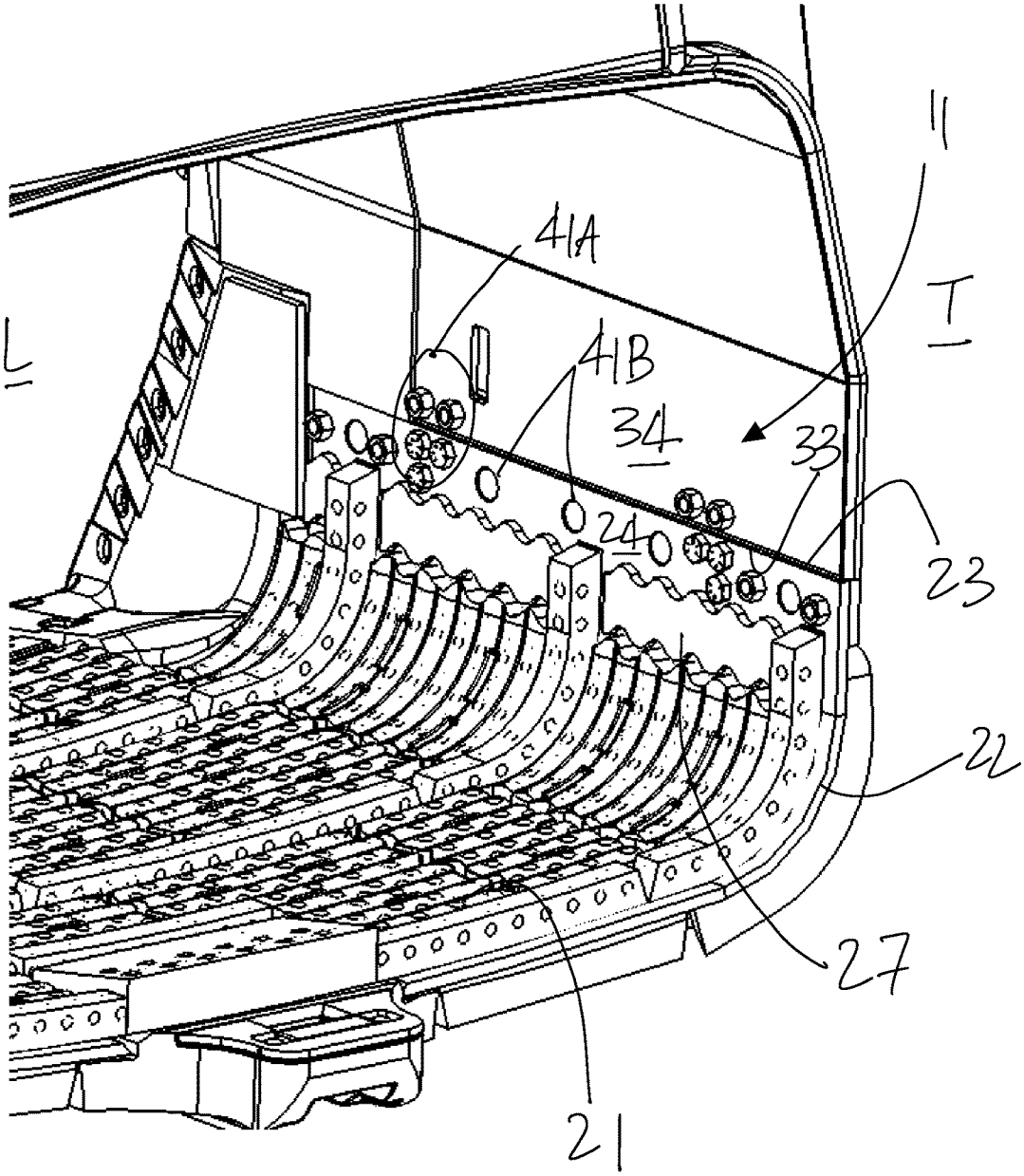
FIG. 6 is perspective view of the excavation bucket of FIG. 4, showing an interior thereof.

Referring now to FIGS. 4 to 6, a variation on the connection assembly is shown. The embodiment of FIGS. 4 to 6 has several components in common with the embodiment of FIGS. 1 to 3, whereby like reference numerals will refer to like components. The body of the bucket 10 has the bowl 20 and the upper frame 30, and the bowl and the upper frame 30 may be interconnected by support member 50 and wedge member 51. The bowl 20 forms the bottom of the bucket 10 and features the lip 12. The upper frame 30 is the upper part of the bucket 10, and features the various connectors 13 and the pivot supports 14, among other features. The upper frame 30 interfaces the bucket 10 to a vehicle or operating equipment, such as to a boom or crane, for example.

In FIGS. 4 to 6, the bowl 20 may be defined by a single metallic member, or multiple interconnected members. The bowl 20 has the bottom portion 21 that is generally planar. The bottom portion 21 may be referred to as a plate, panel, etc. For reference purposes, a X-Y referential is shown, with the bottom portion 21 being generally parallel to the axis X. Lateral portions 22 project upwardly, i.e., along axis Y, on both sides of the bottom portion 21. In an aspect, the lateral portions 22 are integrally connected to the bottom portion 21, for example as a monoblock construction, or as welded or otherwise secured permanently together. The bowl 20 may define a curved transition from the bottom portion 21 to the lateral portions 22, as shown. However, this is merely an option as the lateral portions 22 may be in a square relation with the bottom portion 21. The lateral portions 22 are delimited by top edges 23, that will come into contact with corresponding edges of the upper frame 30. In the figures, the top edges 23 are rectilinear surfaces, but other shapes are considered.

As shown in FIGS. 4 to 6, the top edge 23 may be part of a lateral wall portion 24 that is generally flat. The lateral wall portion 24 may be part of the lateral portions 22 of the bowl 20. In an aspect, the lateral wall portion 24 is an elongated plate member, that is planar along axes X and Y. The elongated plate member may have a generally uniform thickness, and may be sheet metal, as one possibility. The lateral wall portion 24 has holes therein, for instance a first set of holes 24A and a second set of holes 24B. The holes 24A of the first set may be smaller in diameter than the holes 24B of the second set. In the illustrated embodiment, the holes 24A are in a polygonal pattern, but other patterns are may be present. The holes 24A are provided to connect the wedge member 51 to the bowl 20, while the holes 24B are provided to connect the support member 50 to the bowl 20, as described below.

Other components of the bowl 20 or connected to the bowl 20 include corner lips 25 that extend from the lip 12 to the lateral wall portion 24. The corner lips 25 may be present to assist in directing earth into the bucket 10, and may be an integral part of the lip 12. Reinforcement ribs 26 or like reinforcement members may be formed onto the bowl 20 to reinforce the bowl 20. The reinforcement ribs 26 may extend from top edge 26 on one side of the bowl 20 to top edge 26 on the other side of the bowl 20, but other arrangements are possible as well. Wear members 27 may be on any of the surfaces of the bowl 20, and may be removably connected to the bowl 20, to protect the core material of the bowl 20. These components and others may or may not be present.

Still referring to FIGS. 4 to 6, the upper frame 30 is described in further detail. While the bowl 20 may have a generally U-shape from a leading point of view at L, the upper frame 30 may be said to have an inverted U-shape. The "inverted" is when the bucket 10 is horizontal as in FIG. 4. However, in use the bucket 10 may have other orientations, whereby "inverted" is used to described the horizontal orientation of the upper frame 30.

The upper frame 30 has the top portion 31 that is generally planar, with the connectors 13 and pivot members 14 projecting upwardly from the top portion 31. The top portion 31 may be referred to as a plate, panel, etc. In the X-Y referential, the top portion 31 is generally parallel to the axis X. Lateral portions 32 project downwardly, i.e., along axis Y, on both sides of the top portion 31. In an embodiment, the lateral portions 32 are integrally connected to the top portion 31, for example as a monoblock construction, or as welded or otherwise secured permanently together. The upper frame 30 may define a curved transition from the top portion 31 to the lateral portions 32, as shown, and contributing to the inverted U-shape. However, this is merely an option as the lateral portions 32 may be in a square relation with the top portion 31. The lateral portions 32 are delimited by bottom edges 33, that will come into contact with the corresponding top edges 23 of the bowl 20, in coplanar contact. In the figures, the bottom edges 33 are rectilinear surfaces to match the top edges 23, but other shapes are considered, such as complementary shapes.

As shown, the bottom edge 33 may be part of a lateral wall portion 34 that is generally flat. The lateral wall portion 34 may be part of the lateral portions 32 of the upper frame 30. In an embodiment, the lateral wall portion 34 is an elongated plate member, planar along axes X and Y. The elongated plate member may have a generally uniform thickness, for example in the form of sheet metal, as one possibility. The lateral wall portion 34 has holes therein, for instance holes 34A. The holes 34A may be of the same diameter as the holes 24A of bowl 20, as a possibility. In the illustrated embodiment, all holes 34A extend in a single row, but other patterns are may be present. The holes 34A are provided to connect the wedge member 51 to the upper frame 30, as described below, with fasteners.

The supports 35 are mounted to the lateral wall portion 34, and may be said to be part of the lateral wall portion 34. In an embodiment, the supports 35 are reinforcement beams on an outer surface of the upper frame 30. The supports 35 may define holes 35B at a bottom end. The holes 35B may have the same diameter as the holes 24B in the lateral wall portion 24 of the bowl 20. The holes 35B are spaced apart in a similar pattern as the holes 24B, such that when the bowl 20 is assembled to the upper frame 30, the holes 35B are aligned with some of the holes 24B. The supports 35 further define lateral edges 35C, the edges 35C defining rectilinear surfaces used for abutment. Other shapes are possible as well.

Still referring to FIGS. 4 to 6, the support member 50 is shown having a flat body. For instance, the support member 50 is machined from a plate, but may also be manufactured in other ways, such as by being cast. The support member 50 in the illustrated embodiment has a trapezoid shape, as an option among other shapes (e.g., triangle). The support member 50 may have weld seams 50A (or plug welds, weld lines, etc) as the support member 50 may be welded to the lateral wall portion 34. Other configurations are considered to secure the support member 50 to the upper frame 30, including fasteners. The support member 50 may further include holes 50B. The holes 50B are spaced apart in a similar pattern as some of the holes 24B in the lateral wall portion 24, such that when the bowl 20 is assembled to the upper frame 30 with the support member 50, the holes 50B are aligned with the holes 24B. The support member 50 may further include abutment edges 50C. The abutment edges 50C are oblique relative to the X-Y referential. It may therefore be said that the abutment edges 50C face at least partially upward.

The wedge members 51 may also have plate bodies, for instance machined from a plate, but may also be manufactured in other ways, such as by being cast. The wedge members 51 in the illustrated embodiment also have a trapezoid shape, as an option among other shapes (e.g., triangle). The wedge members 51 may include holes 51A. The holes 51A are spaced apart in similar patterns as the holes 24A in the lateral wall portion 24 and as the holes 34A in the lateral wall portion 34, such that when the bowl 20 is assembled to the upper frame 30 with the support member 50 and the wedge members 51, the holes 51A are aligned with the holes 24A and 34A. The wedge members 51 may further include abutment edges 51C. On one side, the abutment edges 51C are oblique relative to the X-Y referential, with on the other side the abutment edges 51C may be generally vertical.

When assembled, the wedge members 51 in the embodiment of FIGS. 4 to 6 are wedged between the support member 50 and the supports 35. The edges 35C, 51C are against each another, and the edges 50C and 51C are also against each other.

Fasteners 41A, such as bolts and nuts, or any other type of fastener, may pass through the pairs of holes 24A and 51A, and through the pairs of holes 34A and 51A, so as to secure the wedge members 51 to the bowl 20 and to the upper frame 30, respectively. The nuts of the fasteners 41A may be inward or outward of the bucket. Other arrangements are possible. The fasteners 41A ensure that the wedge members 51 remain connected to the bowl 20 and to the upper frame 30.

Pins 41B may pass through the pairs of holes 24B and 35B, respectively in the lateral wall portion 24 and in the supports 35, or through the pairs of holes 24B and 50B. The pins 41B may also be referred to as axles, shafts, etc. and have load bearing capacity. The pins 41B are hence fitted so as to be solidly received in the holes 24B, 35B and 50B. The fitting may be a force fit, an interference fit, among other possibilities. Therefore, the pins 41B assist in having the upper frame 30 support the weight of the bowl 20.

Consequently, when the bucket 10 is assembled in the manner shown in FIGS. 4 to 6, a seam (i.e., junction line, intersection, joint line) between the bowl 20 and the upper frame 30 is defined by the top edge 23 and the bottom edge 33 being one against the other, in coplanar engagement. While not shown, joint features may be present at the seam, such as tongue and groove, for example. The supports 35 of the upper frame 30 overlap the seam, by lying against the lateral wall portion 24 of the bowl 20, with the pins 41B being located at this overlap. The support member 50 and wedge members 51 also overlap the seam, by being connected to both the lateral wall portions 24 and 34, by the fasteners 41A, or via the pins 41B and weld seams 50A. Therefore, at the seam between the bowl 20 and the upper frame 30, the supports 35, the support member 50 and wedge members 51 define an additional layer of material that adds to the structural integrity of the sides of the bucket 10.

Again, in the embodiment of FIGS. 4-6, the bowl 20 accommodates earth or like material during use. Therefore, the interconnection between the bowl 20 and the upper frame 30 must take into consideration the weight of the bowl 20 and of the load being carried in the bucket 10. The configuration of the support member 50 and wedge members 51 contribute to the weight support, with the wedge members 51 defining a downwardly facing surface in the edges 51C contacting the upwardly facing abutment edges 50C of the support member 50. The pins 41B are located in the vicinity of the edge engagement between edges 50C and 51C, such as in vertical alignment.

The embodiments of FIGS. 1 to 3 and of FIGS. 4 to 6 may generally be described as defining a bucket to including the bowl 20 defining the lip 12 of the bucket 10. The upper frame 30 interfaces the bucket 10 to equipment. The bowl 20 and the upper frame 30 are against one another at seams so as to define an inner cavity 11. Supports extend over the seams, with one of the supports connected to the upper frame and defining an abutment surface facing at least partially upwardly, and with another one of the supports connected to the bowl and defining another abutment surface facing at least partially downwardly, the abutment surfaces being in contact abutment with one another. In an embodiment, the bowl 20 may be replaced with another while the frame 30 remains connected to equipment.

Surfaces said to be facing downwardly, whether completely or partially, refer to the orientation of the bucket 10 in which the bottom of the bowl 20 is parallel to the ground, i.e., axis X being parallel to the ground. The tabs 40B (FIGS. 1 to 3) face downwardly as a normal to their surfaces contacting the shoulders 35A is generally parallel to axis Y. The surfaces of the edges 51C (FIGS. 4 to 6) may also be said to extend partially downwardly, as a normal to their surfaces has a downward Y axis component. Likewise, surfaces said to be facing upwardly, whether completely or partially, refer to the orientation of the bucket 10 in which the bottom of the bowl 20 is parallel to the ground, i.e., axis X being parallel to the ground. The shoulders 35A (FIGS. 1 to 3) face upwardly as a normal to their surfaces contacting the tabs 40B is generally parallel to axis Y. The surfaces of the edges 50C (FIGS. 4 to 6) may also be said to extend partially upwardly, as a normal to their surfaces has an upward Y axis component.

In a variant, there is provided a method for assembling a bucket such as the bucket 10, as can be seen from FIGS. 1-3 and 4-6. The method may include one or more of: positioning an upper frame on top of a bowl along seams, in non-connected abutment contact; attaching supports to the upper frame and/or to the bowl, the supports overlapping the seam, including abutting at least one abutment surface of the supports connected to the upper frame and facing at least partially upwardly, against at least another abutment surface of the supports connected to the bowl and facing at least partially downwardly; attaching supports to the upper frame and/or to the bowl includes attaching the supports to an exterior of the bucket; attaching supports to the upper frame and/or to the bowl includes covering the seam completely on the exterior of the bucket; detaching the bowl from the upper frame; and/or assembling a replacement bowl to the upper frame.

The invention claimed is:

1. A bucket comprising:

a bowl defining a lip of the bucket, an upper frame configured for interfacing the bucket to equipment, the bowl and the upper frame being against one another at seams so as to define an inner cavity, and supports extending over the seams, with at least one of the supports connected to the upper frame by fasteners and defining at least one abutment surface facing at least partially upwardly, and with at least another one of the supports connected to the bowl by fasteners and defining at least another abutment surface facing at least partially downwardly, the abutment surfaces being in contact abutment with one another, wherein one or more of the supports is separate from the bowl and the upper frame and is installable to the bowl and the upper frame subsequently to the bowl and the upper frame being against one another to overlap one or more of the seams.

2. The bucket according to claim 1, wherein the seams are rectilinear.

3. The bucket according to claim 1, wherein the bowl has a U-shape body, and the upper frame has an inverted U-shape body.

4. The bucket according to claim 1, wherein the supports are on an exterior of the bucket.

5. The bucket according to claim 1, wherein two of the supports for each of the seams are reinforcement beams extending vertically along the upper frame and below the seams.

6. The bucket according to claim 5, wherein the reinforcement beams have shoulders, the at least one abutment surface facing at least partially upwardly being part of the shoulders.

7. The bucket according to claim 6, wherein the at least one abutment surface facing at least partially upwardly being horizontal when the bucket is horizontal.

8. The bucket according to claim 5, wherein the at least another one of the supports being provided for each of the seams, the at least another one of the supports being an elongated plate with tabs, the tabs defining the at least another abutment surface facing at least partially downwardly.

9. The bucket according to claim 5, wherein the reinforcement beams are connected to the bowl by pins.

10. The bucket according to claim 5, wherein the supports include wedge members between the reinforcement beams, and a trapezoid support member between the wedge members, for each said seam.

11. The bucket according to claim 10, wherein the wedge members define the at least another abutment surface facing at least partially downwardly, and the trapezoid support member defines the at least one abutment surface facing at least partially upwardly.

12. The bucket according to claim 11, wherein a contact surface between the wedge members and the reinforcement beams are vertical when the bucket is horizontal.

13. The bucket according to claim 10, wherein the trapezoid support member is welded to the upper frame.

14. The bucket according to claim 1, wherein the supports cover an entirety of the seams on an exterior of the bucket.

15. The bucket according to claim 5, wherein the reinforcement beams extend to a top of the upper frame.

16. A method for assembling a bucket comprising:

positioning an upper frame on top of a bowl along seams;

subsequently to the positioning the upper frame on top of the bowl along the seams, attaching supports to the upper frame and/or to the bowl with fasteners, the supports overlapping the seams, including abutting at least one abutment surface of the supports connected to the upper frame and facing at least partially upwardly, against at least another abutment surface of the supports connected to the bowl and facing at least partially downwardly.

17. The method according to claim 16, wherein attaching supports to the upper frame and/or to the bowl includes attaching the supports to an exterior of the bucket.

18. The method according to claim 17, wherein attaching supports to the upper frame and/or to the bowl includes covering the seam completely on the exterior of the bucket.

19. The method according to claim 16, including detaching the bowl from the upper frame.

20. The method according to claim 19, including assembling a replacement bowl to the upper frame.

* * * * *